US005697532A

United States Patent [19]

Wilde et al.

[11] Patent Number: 5,697,532

[45] Date of Patent: Dec. 16, 1997

[54] METERED-DOSE AEROSOL VALVES

[75] Inventors: Trevor J. Wilde, Burnley; Philip Bolton, Blackburn, both of England

[73] Assignee: Minnesota Mining and Manufacturing Company, St. Paul, Minn.

[21] Appl. No.: 553,247

[22] PCT Filed: Jun. 13, 1994

[86] PCT No.: PCT/GB94/01265

§ 371 Date: Nov. 14, 1995

§ 102(e) Date: Nov. 14, 1995

[87] PCT Pub. No.: WO94/29192

PCT Pub. Date: Dec. 22, 1994

[30] Foreign Application Priority Data

Jun. 14, 1993 [GB] United Kingdom ..... 9312196

[51] Int. Cl.[6] ..... B67D 83/00

[52] U.S. Cl. ..... 222/402.16; 222/402.2; 222/402.24; 222/402.25

[58] Field of Search ..... 222/402.1, 402.16, 222/402.2, 402.24, 402.25

[56] References Cited

U.S. PATENT DOCUMENTS

| | | | |
|---|---|---|---|
| 3,176,889 | 4/1965 | Potapenko et al. | 222/402.2 |
| 3,209,960 | 10/1965 | Green | 222/402.24 |
| 3,394,851 | 7/1968 | Gorman | 222/402.2 |
| 4,015,752 | 4/1977 | Meuresch et al. | 222/402.16 |
| 4,078,705 | 3/1978 | Butcher | 222/402.24 |

FOREIGN PATENT DOCUMENTS

| | | |
|---|---|---|
| 125865 A3 | 11/1984 | European Pat. Off. . |
| 2615124 | 5/1987 | France . |
| 1054307 | 3/1964 | United Kingdom . |
| 973623 | 10/1964 | United Kingdom . |
| 2032007 | 4/1980 | United Kingdom . |
| 2206100 | 12/1988 | United Kingdom . |
| 2209514 | 5/1989 | United Kingdom . |
| 2216872 | 10/1989 | United Kingdom . |
| WO 92/11190 | 7/1992 | WIPO . |

OTHER PUBLICATIONS

U.K. Search Report dated Jul. 23, 1993.
PCT International Search Report dated Sep. 20, 1994.
PCT International Preliminary Examination Report dated Sep. 25, 1995.

*Primary Examiner*—Joseph Kaufman
*Attorney, Agent, or Firm*—Gary L. Griswold; Walter N. Kirn; Jeffrey J. Hohenshell

[57] ABSTRACT

A metered dose dispensing valve for use with an aerosol container is disclosed. The valve comprises, as a single integral component, a rim gasket for sealing the valve to the aerosol container, a sealing flap for pressure filling the valve, and an insert which takes up dead volume within the valve.

7 Claims, 3 Drawing Sheets

METERED-DOSE AEROSOL VALVES

FIELD OF THE INVENTION

This invention relates to metered-dose dispensing valves and in particular to valves for dispensing medicament from pressurized aerosol containers.

BACKGROUND

Known metering valves for pressurized dispensing containers usually have a metering chamber within the valve, the metering chamber having seals at its upper and lower end and being filled with a fresh dose of product to be dispensed, immediately after the previous dose has been dispensed. A valve stem slides through the seals and is movable between an inoperative position where the metering chamber is filled with product to be dispensed and an operative position in which the metered-dose of product is dispensed through the valve stem. The valve stem is spring urged into its inoperative position.

Some metering valves are equipped with a pressure filling valve which allows the aerosol container to be filled through the dispensing valve. The pressure filling valve generally comprises a one way flap valve on the side of the metering chamber and the aerosol container is filled by moving the valve stem to its operative position and passing the aerosol propellant composition under pressure through the valve stem into the metering chamber and thence through the pressure filling valve into the aerosol container.

Many metering valves also possess means to assist in dispensing the entire contents from the container. Such means may comprise a bottle emptier which envelopes the metering chamber defining a capillary pathway for passage of aerosol composition between the bottle emptier and metering chamber. The inlet to the passageway is positioned such that it will be contacted by the last remaining portion of the aerosol composition. Alternatively, the valve may be provided with an insert which occupies any dead volume such that the last remaining portion of the aerosol composition will be positioned in the vicinity of the entrance to the metering chamber.

EP 0125865 discloses a valve assembly which allows pressure filling of an aerosol container and dispensing of metered volumes of material therefrom comprising:

a casing member adapted to form at least the top portion of an aerosol container, a first hollow body secured inside of the casing member defining a metering tank, the metering tank having a pressure filling valve comprising an aperture in the metering tank communicating with the aerosol container which aperture is adjacent the casing member and covered by a sealing member which prevents passage of material from the aerosol container to the metering tank but allows passage of material from the metering tank to the aerosol container when there is sufficient pressure difference between the metering tank and aerosol container, an elongate valve member sealingly extending through respective apertures in the casing member and metering tank capable of longitudinal movement between a closed and dispensing position, such that in the dispensing position there is an open channel through the elongate valve member connecting the metering tank with the outside environment and the metering tank is sealed to prevent passage of material from the aerosol container to the metering tank, and in the closed position the elongate valve member allows passage of material from the aerosol container to the metering tank and prevents passage of material from the metering tank to the outside environment, and a second hollow body retained upon and forming a shroud around the metering tank, the shroud extending substantially to the casing member and covering said sealing member of the metering tank to allow only limited movement thereof, the shroud and metering tank defining at least one passage through which material from the aerosol container may pass into the metering tank when the elongate valve member is in the closed position.

One problem associated with known metering valves is that they comprise many components which require precision manufacture and complex, accurate assembly. There is a desire to reduce the number of components without deleteriously affecting the performance of the valve.

U.S. Pat. No. 3,176,890 discloses a pressurised container, comprising:

a container having a neck portion;

a valve assembly fastened to said neck portion and including a housing member;

a passageway through said housing member and including an upper end, said passageway being adapted to communicate with the interior of the container;

vertically spaced intermediate and lower continuous flange elements with inner lip portions provided in said passageway, the intermediate flange element and the upper end of the passageway defining in part a transfer chamber, and the intermediate and lower flange elements defining in part a measuring chamber;

an elongated stem member mounted in the passageway for axial movement relative to the housing member between an open position and a closed position, said stem member containing an upper wall surface adapted to engage the lip portion of the intermediate flange element in sealing relationship, and a lower wall surface adapted to engage the lip portion of the lower flange element in sealing relationship;

means providing communication between the measuring chamber and the transfer chamber when the stem member is in the closed position, the lip portion of the lower flange element being in sealing engagement with the lower wall surface when the stem member is in said closed position;

the lip portion of the intermediate flange element and the upper wall surface being in sealing engagement, and the lip portion of the lower flange element and the lower wall surface being in axial spaced relationship to provide communication between the interior of the container and the measuring chamber when the stem member is in the open position; and passage means between the exterior of the container and the transfer chamber. The valve assembly may consist essentially of two parts which can be moulded from conventional plastic materials.

SUMMARY OF THE INVENTION

The present invention provides alternative constructions of aerosol, valves.

The invention provides valves which comprise:

a valve ferrule having a rim and associated gasket for engaging an aerosol container and an aperture therethrough;

a metering tank having walls defining an exterior, an internal metering chamber, an inlet orifice, an inlet end, and an outlet end;

an elongate valve stem having a filling channel, a filling end, a discharge end, and a discharge orifice;

in which the outlet end of the metering tank is in sealing engagement with the valve ferrule, the discharge end of the valve stem passes through both the valve ferrule aperture and the outlet end of the metering tank and is in slidable sealing engagement with the valve ferrule;

the filling end of the valve stem passes through and is in slidable engagement with the inlet orifice of the metering tank;

and the valve stem is movable between an extended closed position in which the filling channel of the valve stem allows open communication, via the inlet orifice, between the interior and the exterior of the metering chamber and the outlet end of the metering tank is closed, and a compressed open position in which the inlet orifice of the metering tank is in sealing engagement with the filling end of the valve stem and the discharge orifice of the valve stem allows open communication between the interior and exterior of the metering chamber;

a pressure filling valve comprising an aperture in a wall of the metering chamber sealed with a movable flap;

an insert positioned with the valve ferrule and around the movable flap chamber to occupy dead volume of the valve, the insert preferably being shaped to direct aerosol composition towards the inlet orifice of the metering tank;

the rim gasket, movable flap and insert being formed as a single integral component.

The invention combines three components into one simple component making savings in both component manufacture and assembly time. Furthermore, since the sealing flap and insert are integral to the sealing gasket they are secured against displacement which might otherwise cause failure of the valve.

The "dead volume" of a valve is that space occupied by aerosol formulation from which it cannot be dispensed from the valve when the aerosol container is otherwise empty. The dead volume extends around the metering chamber of the valve and between the valve ferrule and/or neck of the aerosol container to the level of the inlet to the metering chamber.

In accordance with one embodiment of the invention a combined gasket, flap and insert component may completely envelope the valve stem extending through the inlet end of the metering chamber, one or more apertures being provided adjacent the inlet of the metering chamber to facilitate passage of contents to the metering chamber. This arrangement reduces potential drug migration problems.

The gasket, flap, insert component may be formed of any suitable material which is sufficiently elastic and is not deleteriously affected by the contents of the container. Suitable materials include thermoplastic elastomers and rubbers e.g. as disclosed in W092/11190.

BRIEF DESCRIPTION OF THE DRAWINGS

The invention will now be described with reference to the accompanying drawings in which.

DETAILED DESCRIPTION

Figure 1:
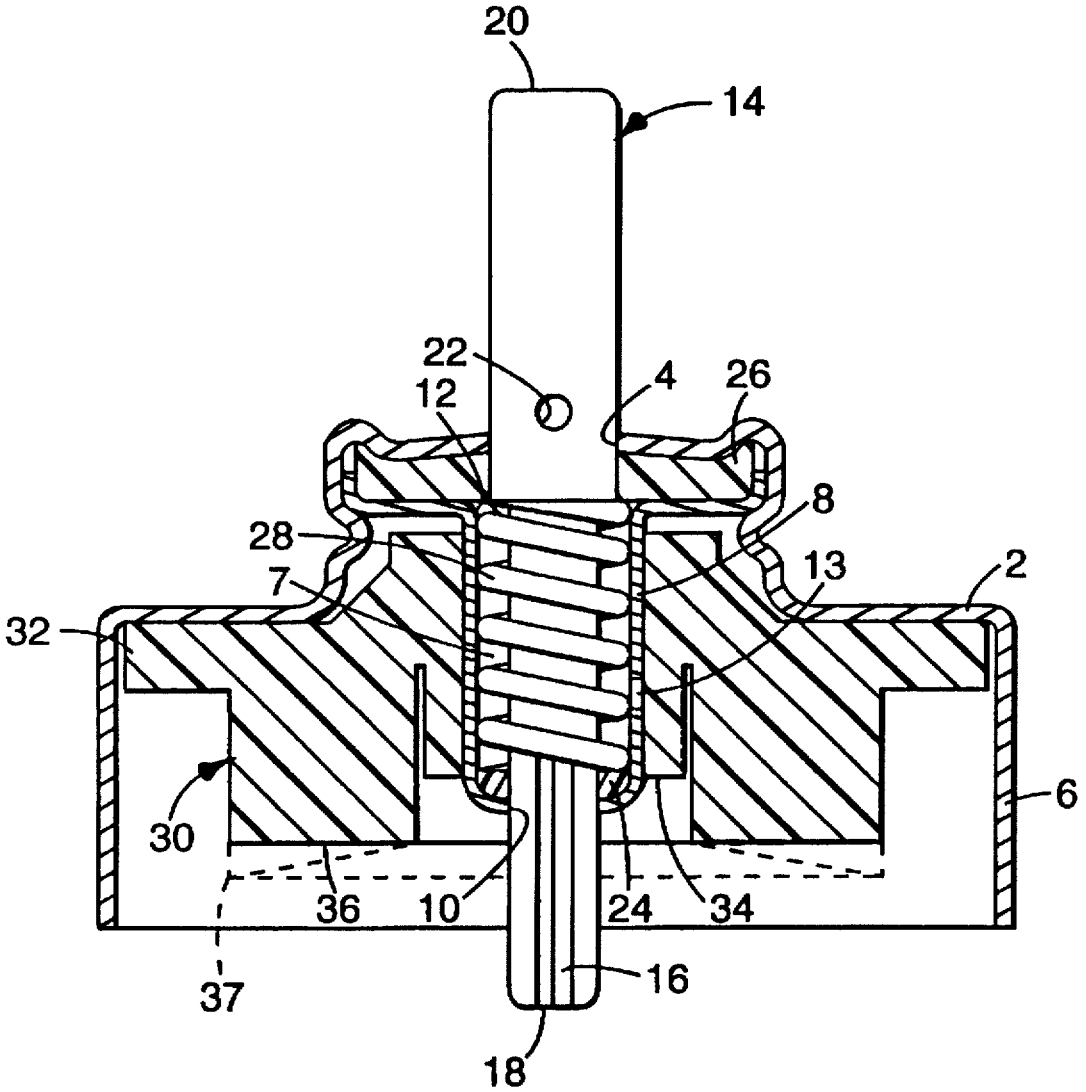
FIG. 1 represents a cross-section through a metered-dose dispensing a valve in accordance with the invention.

In the drawings like reference numerals refer to like parts.

The valve shown in FIG. 1 comprises a valve ferrule (2) having an aperture (4) and side portion (6) which is intended to be crimped over the neck of an aerosol container (not shown). A metering chamber (7) is defined by a wall (8) positioned within the valve ferrule and has an inlet end (10) and an outlet end (12) and a pressure filling port (13). A valve stem (14) having a filling channel (16) a filling end (18) a discharge end (20) and discharge orifice (22) extends through the inlet (10) and outlet (12) end of the metering chamber (7) and through the aperture (4) of the valve ferrule. The inlet (10) and outlet (12) ends of the metering chamber (8) are provided with seals (24, 26) respectively such that the valve stem is in sliding sealing engagement. A biasing spring (28) is positioned within the metering chamber biasing the valve stem to its inoperative position as shown in FIG. 1.

In the inoperative position contents of the aerosol container (not shown) are free to enter the metering chamber (7) via the filling channel (16). If the valve stem (14) is depressed to its operative position, the filling channel (16) moves through the seal (24) at the inlet end (10) of the metering chamber and the inlet end is sealed. The discharge orifice (22) of the valve stem passes through seal (26) into the metering chamber (8) allowing the contents to discharge through the valve stem via the outlet end (22).

In accordance with the invention the valve comprises as a single, integral component (30), a rim gasket (32) for sealing the valve to an aerosol container, a flap or sleeve (34) sealing the pressure filling port (13) and an insert (36) occupying dead space within the valve such that the contents of the container are directed to the inlet (10) of the metering chamber. The component (30) may readily be precision moulded from suitable elastomeric materials.

In use the neck of an aerosol container is inserted in the ferrule (2) until the end of the neck abuts the gasket (32) of the component (30). The side portion (6) is crimped over the neck to secure the valve forming a gas-tight seal by compressing gasket (32) between the ferrule (2) and the neck of the aerosol container.

The aerosol container may be pressure filled by depressing the valve stem (14) and introducing the aerosol formulation under pressure through the discharge end (20). The formulation passes through the valve stem (14) and enters the metering chamber (7) via the discharge orifice (22). The pressure of the formulation is sufficient to displace the sleeve (34) from the pressure filling port (13) thereby allowing the aerosol formulation to enter the aerosol container.

The insert (36) occupies dead volume within the ferrule (2). In absence of the insert (36) that space would need to be occupied by aerosol formulation which would be wasted since, when the valve is inverted for dispensing, the formulation would be below the level of the inlet end (10) of the metering chamber (11) and could not enter the metering chamber to be dispensed. Generally, the insert occupies at least 50% of the dead volume, preferably at least 75%, more preferably at least 90% of the dead volume.

In one embodiment the insert (36) may be shaped as shown in dotted outline (37) to direct the formulation towards the inlet end (10) of the metering chamber when the aerosol container is substantially empty.

Figure 2:
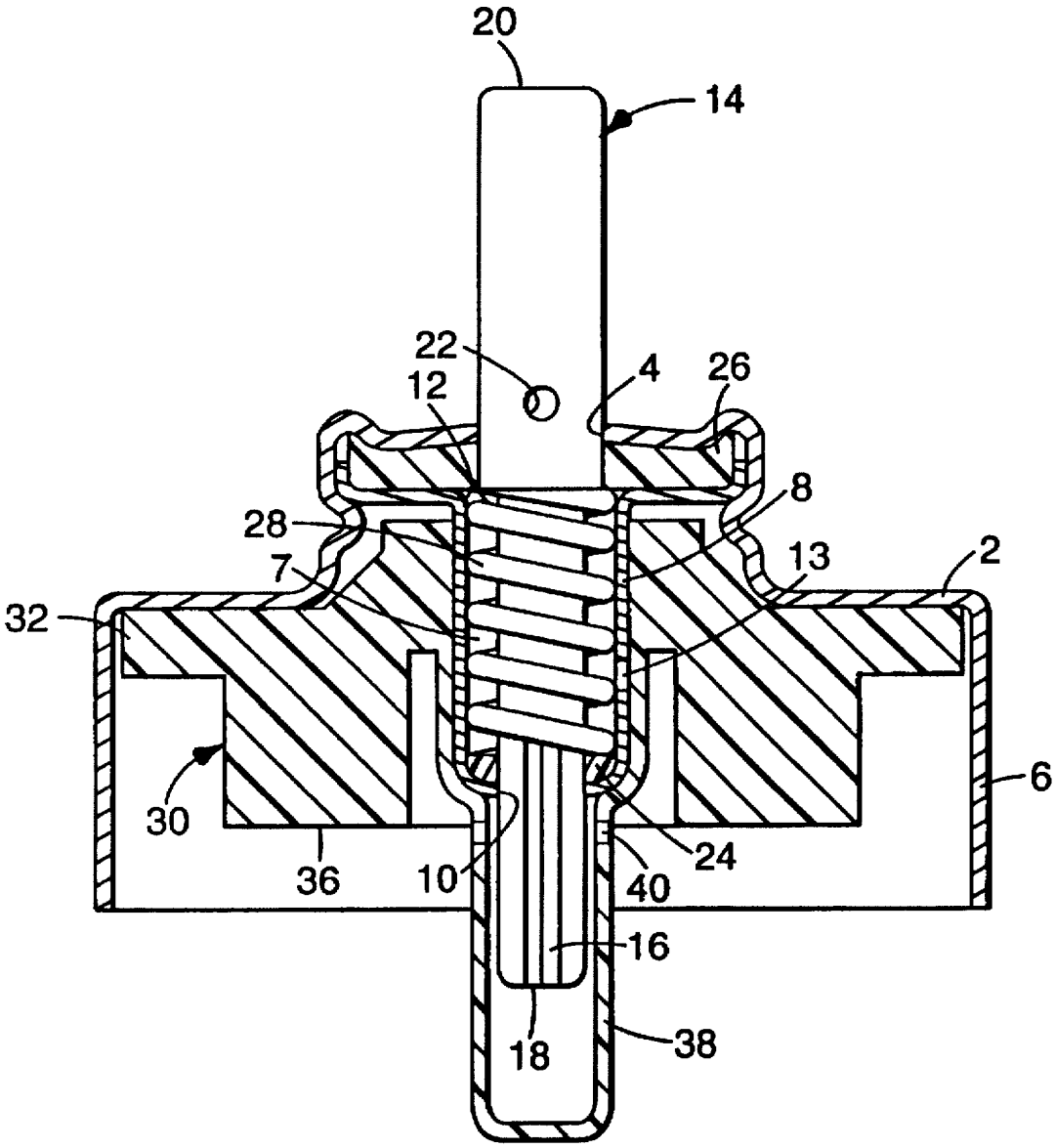
FIG. 2 represents a cross-section through a second metered-dose dispensing valve in accordance with the invention and FIG. 3 represents a cross-section through a third metered-dose dispensing valve in accordance with the invention.

FIG. 2 shows a modification of the valve of FIG. 1 in which the component (30) is provided with a portion (38)

which envelopes the filling end (18) of the valve stem. Apertures (40) are provided to allow passage of contents of the aerosol container to the inlet (10) of the metering chamber and to allow passage of the composition into the aerosol container via the pressure filling port (13) when the aerosol container is pressure filled. This arrangement reduces potential drug migration problems.

Figure 3:
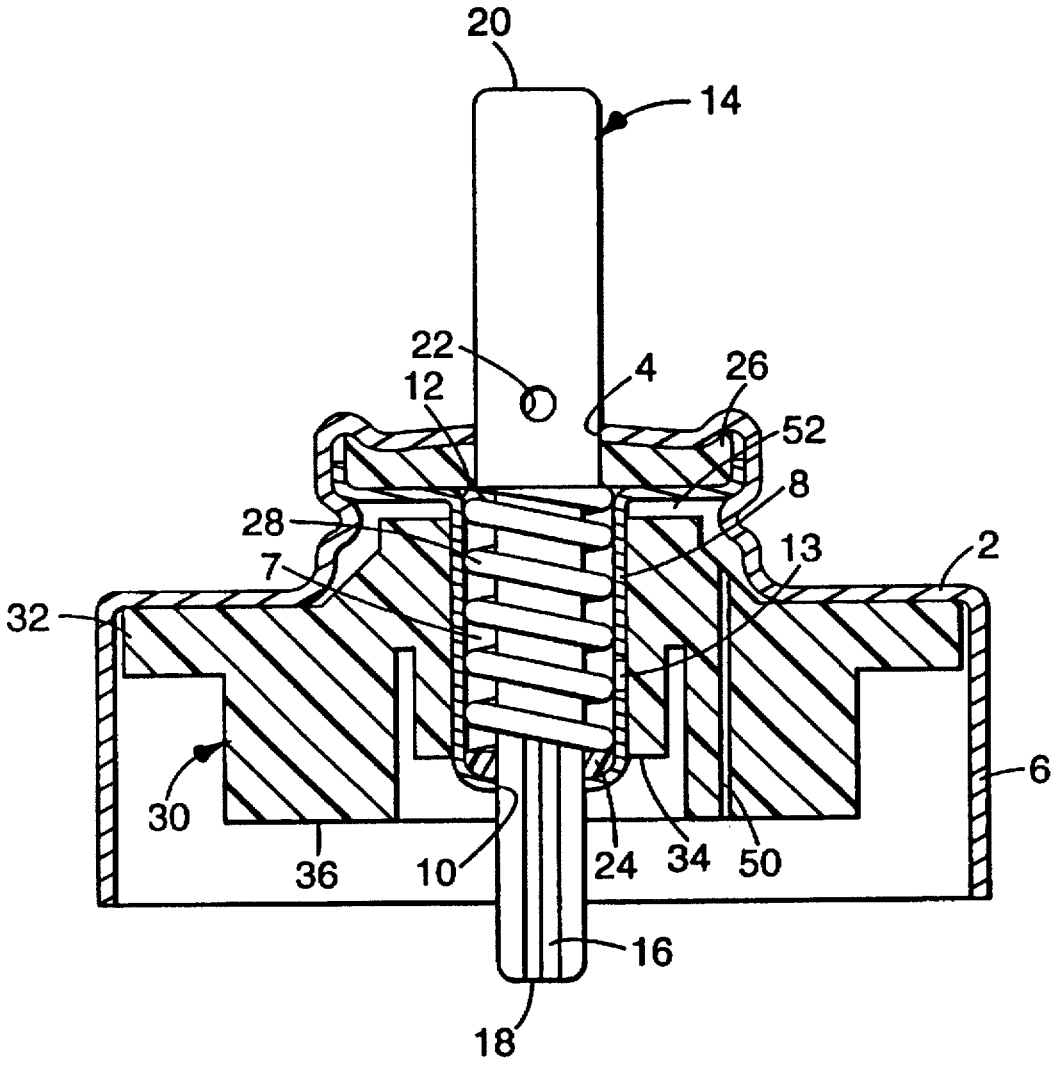

FIG. 3 shows a valve similar to that of FIG. 1 which additionally comprises a channel (50) extending through the component (30). The purpose of the channel (50) is to provide an escape route to any aerosol formulation which, during the pressure filling operation, may pass between the wall (8) of the metering chamber and the component (30) to the region (52). Aerosol formulation which has been forced into region (52) passes through channel (50) into the main body of the aerosol container.

It will be appreciated the component (30) of the invention may readily be assembled on the valve and when the valve has been crimped on the aerosol container the insert portion and gassing flap of the pressure filling valve are secured against accidental displacement thereby reducing the risk of valve failure.

We claim:

1. A metered-dose dispensing valve for use with an aerosol container, the metered dose dispensing valve comprising:

a valve ferrule having a rim and associated rim gasket for engaging an aerosol container and an aperture therethrough;

a metering tank having walls defining an exterior, an internal metering chamber, an inlet orifice, an inlet end, and an outlet end;

an elongate valve stem having a filling channel, a filling end, a discharge end, and a discharge orifice;

wherein the outlet end of the metering tank is in sealing engagement with the valve ferrule, the discharge end of the valve stem passes through both the valve ferrule aperture and the outlet end of the metering tank and is in slidable sealing engagement with the valve ferrule;

wherein the filling end of the valve stem passes through and is in slidable engagement with the inlet orifice of the metering tank; and wherein the valve stem is movable between an extended closed position wherein the filling channel of the valve stem allows open communication, via the inlet orifice, between the interior and the exterior of the metering chamber, and wherein the outlet end of the metering tank is closed, and a compressed open position wherein the inlet orifice of the metering tank is in sealing engagement with the filling end of the valve stem and the discharge orifice of the valve stem allows open communication between the interior and exterior of the metering chamber;

a pressure filling valve comprising an aperture in a wall of the metering chamber sealed with a movable pressure filling flap; and an insert positioned within the valve ferrule and around the metering chamber to occupy dead volume of the valve, the insert being shaped to direct aerosol composition towards the inlet orifice of the metering tank;

wherein the rim gasket, movable pressure filling flap, and insert are formed as a single integral component which is free of engagement with the valve stem.

2. A metered-dose dispensing valve as claimed in claim 1 wherein said single integral component comprises a portion enveloping the end of the valve stem emerging from the metering chamber, said portion having one or more apertures extending therethrough to allow passage of material to the inlet of the metering chamber.

3. A metered-dose dispensing valve as claimed in claim 1 wherein said single integral component additionally comprises a channel for passage of aerosol formulation extending therethrough to prevent aerosol formulation from being trapped between the single integral component and valve ferrule.

4. A metered-dose dispensing valve as claimed in claim 1 wherein said insert occupies at least 50% of the dead volume of the valve.

5. A metered-dose dispensing valve as claimed in claim 1 wherein said insert occupies at least 75% of the dead volume of the valve.

6. A metered-dose dispensing valve as claimed in claim 1, wherein said insert occupies at least 90% of the dead volume of the valve.

7. An aerosol container including a metered-dose dispensing valve, the metered-dose dispensing valve comprising:

a valve ferrule having a rim and associated rim gasket for engaging an aerosol container and an aperture therethrough;

a metering tank having walls defining an exterior, an internal metering chamber, an inlet orifice, an inlet end, and an outlet end;

an elongate valve stem having a filling channel, a filling end, a discharge end, and a discharge orifice;

wherein the outlet end of the metering tank is in sealing engagement with the valve ferrule, the discharge end of the valve stem passes through both the valve ferrule aperture and the outlet end of the metering tank and is in slidable sealing engagement with the valve ferrule;

wherein the filling end of the valve stem passes through and is in slidable engagement with the inlet orifice of the metering tank;

wherein the valve stem is movable between an extended closed position wherein the filling channel of the valve stem allows open communication, via the inlet orifice, between the interior and the exterior of the metering chamber, and wherein the outlet end of the metering tank is closed, and a compressed open position wherein the inlet orifice of the metering tank is in sealing engagement with the filling end of the valve stem and the discharge orifice of the valve stem allows open communication between the interior and exterior of the metering chamber;

a pressure filling valve comprising an aperture in a wall of the metering chamber sealed with a movable pressure filling flap; and an insert positioned within the valve ferrule and around the metering chamber to occupy dead volume of the valve, the insert being shaped to direct aerosol composition towards the inlet orifice of the metering tank;

wherein the rim gasket, movable pressure filling flap, and insert are formed as a single integral component which is free of engagement with the valve stem.

* * * * *